United States Patent [19]

Smollin

[11] Patent Number: 4,590,463

[45] Date of Patent: May 20, 1986

[54] DIGITAL CONTROL OF COLOR IN CRT DISPLAY

[75] Inventor: Charles F. Smollin, Indianapolis, Ind.

[73] Assignee: RCA Corporation, Princeton, N.J.

[21] Appl. No.: 191,909

[22] Filed: Sep. 29, 1980

[51] Int. Cl.[4] ..... G09G 1/16; G09G 1/28

[52] U.S. Cl. ..... 340/703; 340/793; 358/12

[58] Field of Search ..... 340/703, 738, 793, 736, 340/742; 358/13, 12; 364/606

[56] References Cited

U.S. PATENT DOCUMENTS

| | | | |
|---|---|---|---|
| 2,982,811 | 5/1961 | Valensi | 358/13 |
| 3,177,350 | 4/1965 | Abbott et al. | 364/606 |
| 3,482,238 | 12/1969 | Stine | 340/742 |
| 3,603,962 | 9/1971 | Lechner | 340/703 |
| 4,121,283 | 10/1978 | Walker et al. | 340/703 |
| 4,158,200 | 6/1979 | Seitz et al. | 340/793 |
| 4,183,046 | 1/1980 | Dalke et al. . | |
| 4,276,543 | 6/1981 | Miller et al. | 358/13 |

*Primary Examiner*—Marshall M. Curtis

*Attorney, Agent, or Firm*—Joseph S. Tripoli; George E. Haas; George J. Seligsohn

[57] ABSTRACT

The color of a pixel produced on the face of a CRT is determined by the n bits of a hue/saturation digital input signal which is applied to a decoder to select one of $2^n$ output lines of the decoder. Each output line is connected through a red, green and blue resistor triplet and through red, green and blue amplifier channels to respective red, green and blue signal inputs of the CRT. The values of the red, green and blue resistors in a selected resistor triplet determine the color of the pixel. The bits of a brightness signal are used to equally control the gain in the red, green and blue channels.

8 Claims, 2 Drawing Figures

DIGITAL CONTROL OF COLOR IN CRT DISPLAY

FIELD OF THE INVENTION

This invention relates to apparatus for the display of graphic information in color on the face of a cathode-ray-tube (CRT), and particularly to such apparatus in which the colors of the displayed information are determined by digital signals such as may be supplied from a binary memory controlled by a computer.

DESCRIPTION OF THE PRIOR ART

The digital signals needed to control a color CRT include digital signal bits used to control the color and brightness of each picture element (pixel). The color bits normally include a plurality of red bits which are applied through a digital-to-analog (D/A) converter to control the red gun of the color CRT, a plurality of green bits applied through a second D/A converter to control the green gun, and a plurality of blue bits applied through a third D/A converter to control the blue gun. The disadvantages of this method of color selection are:

1. The requirement for expensive digital-to-analog converters.
2. The complexity of the relationship between psychological color specifications and drive voltages.
3. A tendency for many of the resulting colors to be similar to the red, green and blue primaries due to a lack of compensation for the "gamma" (the concave upward current versus voltage characteristic) of the electron guns.
4. The difficulty in providing direct control over any of the individual psychological characteristics of the displayed color, i.e., hue, saturation and brightness.
5. The limited set of chromaticities (hue and saturation combinations) available at multiple brightness levels. For example, if there are three bits for each gun, and a given chromaticity is produced with red, green and blue numerical drives equal to 1, 2, 2 respectively, the only other drive combinations proportional to 1, 2, 2 are 2, 4, 4, and 3, 6, 6, since for three bits the drive voltage is proportional to an integer from 0 to 7.

SUMMARY OF THE INVENTION

In accordance with an example of the present invention, n hue/saturation bits are applied to a decoder to select one of $2^n$ resistor triplets each having a red, a green and blue resistor to control the current to the respective red, green and blue guns of the CRT. Separate brightness bits are applied to the red, green and blue channels to equally affect the currents to the three guns of the CRT.

DESCRIPTION OF THE PREFERRED EMBODIMENT

Figure 1:
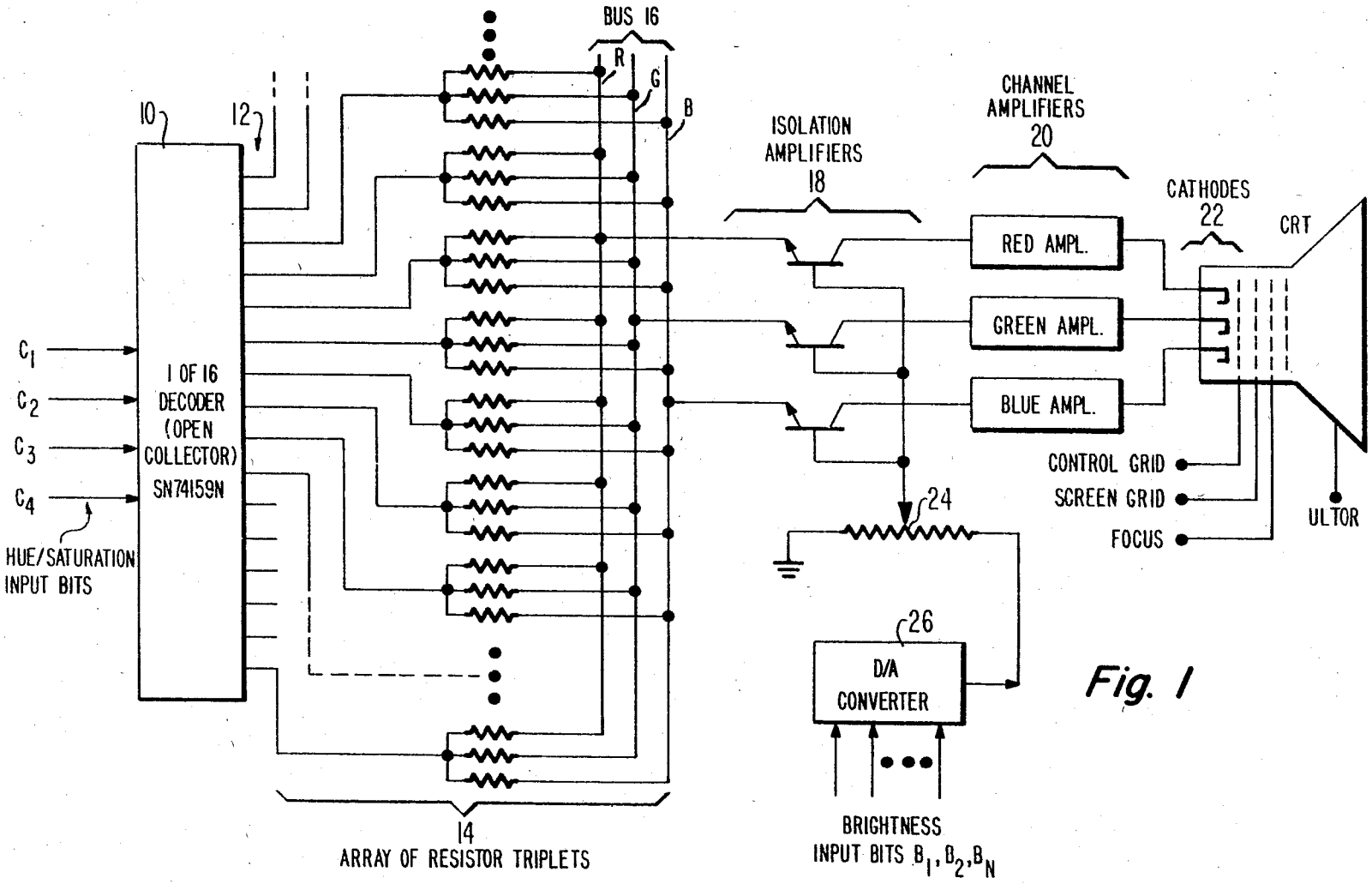
FIG. 1 is a schematic diagram of a system in which the hue, saturation, and brightness of colors displayed on the face of a CRT are controlled by digital input signals.

In FIG. 1 the digital signal defining the color hue and saturation of a pixel to be displayed on the face of a cathode-ray-tube CRT consists of four bits applied to four inputs $C_1$, $C_2$, $C_3$ and $C_4$ of a one-out-of-sixteen decoder 10, which is illustrated as a Type SN74159N integrated circuit unit made by Texas Instruments. The four input bits cause the selection of one-out-of-sixteen output lines 12 of the decoder 10. To generalize, the number of input color bits is designated n, and the number of output lines from the decoder 12 is $2^n$. Four color inputs are employed when it is desired to be able to create sixteen colors on the CRT which are different in hue and/or saturation. Other numbers n of input bits may be employed for the creation of numbers $2^n$ of different colors.

Each one of the sixteen output lines 12 from the decoder 10 is connected to one end of red, green and blue resistors of a resistor triplet in a resistor array 14. The other ends of all red resistors are connected to a red bus R. The other ends of all green resistors are connected to a green bus G. The other ends of all blue resistors are connected to a blue bus B. The red, green and blue buses are connected to the emitters of respective transistors $Q_R$, $Q_G$ and $Q_B$ in isolation amplifiers 18. The collectors of the transistors are connected through respective red, green and blue amplifiers 20 to cathodes 22 of respective red, green and blue guns of the cathode-ray-tube CRT. All base electrodes of isolation transistors $Q_R$, $Q_G$ and $Q_B$ are connected to a tap on a voltage divider 24, which is supplied from a digital-to-analog converter 26 to which a plurality of digital input signal brightness bits $B_1$, $B_2$, $B_N$ are applied. The CRT is provided with beam deflection means (not shown) for raster scanning all the pixels on the face of the tube.

In the operation of the system of FIG. 1, four bits representing a desired color hue and saturation of a pixel are applied to input terminals $C_1$, $C_2$, $C_3$ and $C_4$ of the decoder 10. The input signal selects or enables one of the sixteen output lines 12 of the decoder, and allows current to flow thereto from the three isolation amplifiers 18 through respective red, green and blue buses R, G and B, and through the three respective resistors of the selected resistor triplet in array 14. The amount of current flowing through each resistor of the selected triplet depends on the resistance value of the resistor. Each isolation amplifier 18 transistor is connected in a common base circuit having a low input impedance, so that it prevents the resistors for the same color in non-selected triplets from affecting the current through the resistor in the selected triplet. (The transistors hold the buses R, G and B at the same potential, which is one base-emitter drop removed from the voltage at the tap on potentiometer 24. Therefore, current does not flow from one bus to another via resistors in non-selected triplets.) The resistor values are chosen to provide values of current in the red, green and blue channels from cathodes 22 of the CRT so that the pixel on the face of the CRT has any desired color hue and saturation.

The next following pixel along a scanned horizontal line on the face of the CRT may have a different hue and saturation determined by a different four hue/saturation bits applied to the decoder 10. The color determined by the resistor values in the selected resistor triplet may be any desired color. The various colors provided by the sixteen resistor triplets need not have any arithmetic relationship with each other, because the four input bits select any one of sixteen independent resistor triplets. The colors produced by two consecutive binary digits need have no color similarity or relationship. Therefore, the described system provides complete freedom in the choice of reproducible colors, particularly colors unlike the red, green and blue primary colors, and unlike the usual greenish and bluish colors. The more pleasing warm shades of orange, yellow and brown are easily obtained by appropriate selection of resistor values in the resistor triplets.

The average brightness of the color display on the face of the CRT is controlled by a potentiometer 24 by which an adjustable voltage is applied to the bases of all three transistors in the isolation amplifiers 18. The brightness of each pixel is varied by changing the brightness input of the digital signal applied to the digital-to-analog converter 26. In this way, the brightness of each pixel is controlled independently of the hue and saturation.

The resistor values in the array of resistor triplets 14 can be determined by substituting three variable resistors for the resistors in a given selected triplet, and adjusting the resistors to obtain the desired color. When the adjustments are made, the brightness bits $B_1$ through $B_N$ should all be high ("1"), and the resistors of all triplets should be adjusted to produce colors having the same brightness, as measured by a luminance probe such as the J6523 manufactured by Tektronix, Inc., or by computing the relative luminance from the following formula which is suitable for cathode-ray-tubes using phosphors similar to those currently used by and sold by RCA Corporation in 1980:

Relative luminance $=0.18\ I_R+0.75\ I_G+0.07\ I_B$ where $I_R$, $I_G$ and $I_B$ are the relative cathode currents measured when the CRT is displaying a solid field of the desired color.

An example of suitable resistor values actually used to produce the indicated colors are as follows:

| Resulting Color | Resistor Values (ohms) | | |
|---|---|---|---|
| | Red Circuit | Green Circuit | Blue Circuit |
| Red | 499 | ∞ | 1620 |
| Orange | 511 | 806 | ∞ |
| Yellow | 845 | 866 | ∞ |
| Green-Yellow | 806 | 806 | ∞ |
| Green | ∞ | 649 | ∞ |
| Blue-Green | ∞ | 750 | 845 |
| Blue | ∞ | ∞ | 422 |
| Blue-Purple | 649 | 1000 | 499 |
| Purple | 549 | ∞ | 549 |
| Red-Purple | 511 | ∞ | 806 |
| Pink | 649 | 1000 | 1100 |
| Brown | 806 | 909 | 1820 |
| Light Green | 953 | 806 | 1400 |
| Light Blue | 1000 | 866 | 791 |
| Light Purple | 715 | 1000 | 681 |
| White | 909 | 845 | 953 |

∞ = resistor omitted

Instead of varying resistor values to obtain the desired colors, the resistor values can be determined by first using the following formulas to compute the cathode currents required to make a color having known coordinates (u, v) on a CRT having phosphors similar to those currently used by RCA Corporation:

$w=1-(u+v)$ $U=u/v$ $W=w/v$ $I_R=(5.73\ U-0.49-1.37W)\ I_{RW}$ $I_G=(-1.5\ U+1.76+0.12W)\ I_{GW}$ $I_B=(1.53\ U-3.2+2.1W)\ I_{BW}$ where w, U and W are defined on page 135 of the book entitled "Transmission and Display of Pictorial Information" by D. E. Pearson published by Halstead Press in 1975, and where $I_R$, $I_G$ and $I_B$ are the red, green and blue cathode currents for the desired color, and $I_{RW}$, $I_{GW}$ and $I_{BW}$ are the cathode currents when the CRT is displaying white.

A good approximation of resistor values can then be obtained from the following formula: Where:

$$R=k\ I_k^{-0.35}\ \text{ohms}$$

$I_k$ is the cathode current in milliamperes k is a constant determined from the following formula:

$$k=\frac{(V_{BB}-0.7)\ R_D}{0.7+(R_1//R_2)\ V_1/R_L}$$

Where:

$V_{BB}$ is the DC voltage on the base of $Q_R$ $R_D$ is the resistance of the drive control $R_1//R_2$ is the resistance of $R_1$ in parallel with $R_2$ $R_L$ is the resistance of the load resistor for $Q_6$ $V_1$ is the amount by which the voltage on the red cathode of the cathode-ray-tube must be lowered to increase the cathode current from 0 to 1 milliampere, as determined from the manufacturers data sheets.

The resistor connected between the base of transistor $Q_4$ and the diode is assumed to be equal in value to the resistor connected between the emitter of $Q_4$ and the positive supply.

Figure 2:
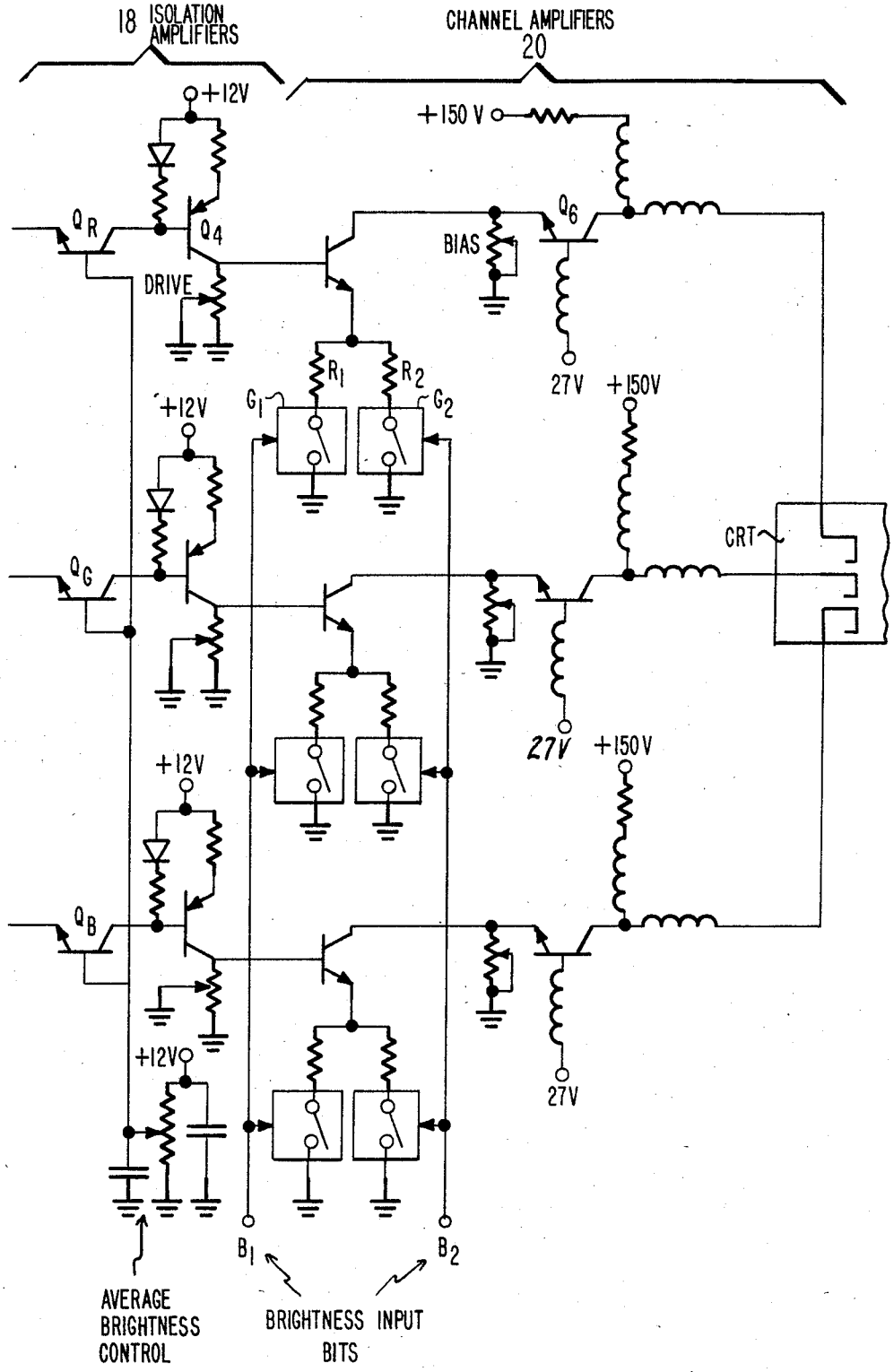
FIG. 2 is a circuit diagram of a portion of the system of FIG. 1 including an alternative way of controlling the brightness of the CRT display.

FIG. 2 is a circuit diagram of isolation amplifier 18 and channel amplifiers 20 in an arrangement which differs from FIG. 1 in that two input brightness bits are used to control the connections of emitter resistors in the three channel amplifiers 20, instead of control voltages applied to the bases of transistors in the isolation amplifier 18. In FIG. 2, the red channel of channel amplifiers 20 includes a first inverting transistor $Q_4$, a second inverting transistor $Q_5$, and a transistor $Q_6$ in a voltage gain circuit with bias control. The emitter of transistor $Q_5$ is provided with two resistors $R_1$ and $R_2$ coupled to ground by switches consisting of open collector transistor-transistor-logic (TTL) gates $G_1$ and $G_2$ enabled by the respective brightness bit input signals from terminals $B_1$ and $B_2$. Resistor $R_2$ is typically twice as large as resistor $R_1$. The digital two-bit signal applied to terminals $B_1$ and $B_2$ causes none, one, or the other, or both of resistors $R_1$ and $R_2$ to be connected from the emitter of transistor $Q_5$ to ground. The gain of transistor $Q_5$ depends on the resistors connected to ground by the brightness bits, as follows:

| $B_1$ | $B_2$ | Gain of $Q_5$ | |
|---|---|---|---|
| 0 | 0 | 0 | 0 |
| 0 | 1 | $1/R_2=$ | $1/R_2$ |
| 1 | 0 | $1/R_2=$ | $2/R_2$ |
| 1 | 1 | $1/R_1+1/R_2=$ | $3/R_2$ |

The digital brightness signal bits therefore provide four different levels 0, 1, 2 and 3 of brightness of the red color on the face of the CRT. The green and blue channel amplifiers are the same as the described red channel amplifier, and the brightness gain of all three channels is controlled equally by the brightness digital signal applied to terminals $B_1$ and $B_2$. The six gates $G_1$ and $G_2$ in all three channels may be included in a single integrated circuit package, Type SN7406N made by Texas Instruments.

What is claimed is:

1. In a display including a cathode-ray-tube having red, green and blue signal input channels, means responsive to n bits of a hue/saturation digital input signal to control the color produced on the face of the cathode-ray-tube, comprising in combination, a decoder receptive to said n input bits and operative to select one of m output lines, where m is an integer greater than one and no greater than $2^n$, an array of m red, green and blue resistor triplets, all resistors of a triplet having one common connection to a respective one of said m decoder output lines, and the other ends of all red, green and blue resistors being connected to respective red, green and blue buses, and red, green and blue channels including isolation amplifiers coupling respective red, green and blue buses to respective red, green and blue signal inputs of said cathode-ray-tube.

2. The combination of claim 1 wherein n is four, and $2^n$ is sixteen.

3. The combination of claim 1, and, in addition, a digital-to-analog converter receptive to a plurality of bits of a brightness input signal, and means using the analog output of said converter to equally control the gain in said red, green and blue channels.

4. The combination of claim 3 wherein the analog output of said converter is applied to said isolation amplifiers in said red, green and blue channels.

5. The combination of claim 1, and, in addition, red, green and blue gain control transistors in said red, green and blue channels, and means responsive to brightness input signal bits to control the gain in said transistors.

6. The combination of claim 5 wherein said means to control the gain includes resistors connected to said transistors, and gate means responsive to said brightness bits to connect said resistors in circuit with said transistors.

7. The combination of claim 5 wherein said means includes emitter resistors, and gates enabled by said brightness bits to control the connections of said emitter resistors to points of reference potential.

8. In a system for displaying in color a pattern of video-information on a color display device, said system including three primary color channels for deriving three respective output signals which are applied as separate inputs to said color display device for determining the color hue and saturation of the displayed color of said pattern; the improvement wherein said system further includes:

digital control means operative to select any single one of m output lines, where m is an integer greater than one, an array of m triplets of resistor means in which each triplet corresponds to a separate discrete composite color determined by the relative values of respective resistors of that triplet which represent each of the three primary color components of the triplet's composite color, all resistors of a triplet having one common connection to a respective one of said digital control means output lines, separate buses corresponding to each one of said three primary colors, each of said buses being connected to the other end of those ones of the resistors of all said triplets which correspond to the same primary color as does that bus, and wherein each of said three primary color channels includes an isolation amplifier to which a respective one of said buses is coupled thereby to supply an input signal to that primary color channel.

* * * * *

UNITED STATES PATENT AND TRADEMARK OFFICE
CERTIFICATE OF CORRECTION

PATENT NO. : 4,590,463

DATED : May 20, 1986

INVENTOR(S) : Charles F. Smollin

It is certified that error appears in the above-identified patent and that said Letters Patent is hereby corrected as shown below:

Column 4, line 59, change the next-to-last line of the chart from "1 0 $1/R_2$= $2/R_2$" to --1 0 $1/R_1$= $2/R_2$--

Column 6, line 25, change "the" (second occurrence) to --that--.

Signed and Sealed this

*Ninth* Day of *September 1986*

[SEAL]

*Attest:*

DONALD J. QUIGG

*Attesting Officer* *Commissioner of Patents and Trademarks*